US008659498B2

(12) United States Patent
Rothwell et al.

(10) Patent No.: US 8,659,498 B2
(45) Date of Patent: Feb. 25, 2014

(54) VARIABLE FREQUENCY PATCH ANTENNA

(75) Inventors: Edward J. Rothwell, Williamston, MI (US); Lynn Greetis, East Lansing, MI (US)

(73) Assignee: Board of Trustees Operating Michigan State University, East Lansing, MI (US)

( * ) Notice: Subject to any disclaimer, the term of this patent is extended or adjusted under 35 U.S.C. 154(b) by 476 days.

(21) Appl. No.: 12/761,064

(22) Filed: Apr. 15, 2010

(65) Prior Publication Data

US 2010/0194663 A1 Aug. 5, 2010

Related U.S. Application Data

(63) Continuation-in-part of application No. PCT/US2008/080076, filed on Oct. 16, 2008.

(60) Provisional application No. 60/999,852, filed on Oct. 19, 2007.

(51) Int. Cl.
*H01Q 3/24* (2006.01)
*H01Q 1/38* (2006.01)

(52) U.S. Cl.
USPC ..... 343/876; 343/700 MS

(58) Field of Classification Search
USPC ..... 343/876
See application file for complete search history.

(56) References Cited

U.S. PATENT DOCUMENTS

| | | | |
|---|---|---|---|
| 4,379,296 | A | 4/1983 | Farrar et al. |
| 6,175,723 | B1 | 1/2001 | Rothwell |
| 6,700,542 | B2 | 3/2004 | Borlez et al. |
| 7,057,561 | B2 | 6/2006 | Hsu |
| 7,136,017 | B2 | 11/2006 | Condon et al. |
| 2003/0214438 | A1 | 11/2003 | Hatch et al. |
| 2009/0096582 | A1 | 4/2009 | Choi et al. |

FOREIGN PATENT DOCUMENTS

| | | |
|---|---|---|
| EP | 0521377 | 1/1993 |
| EP | 1387435 | 2/2004 |
| EP | 1693925 | 8/2006 |
| EP | 1936738 | 6/2008 |
| WO | 01/91235 A | 11/2001 |
| WO | 2009/052234 | 4/2009 |
| WO | 2009/082300 | 7/2009 |

OTHER PUBLICATIONS

"Self-Structuring Antennas," Coleman et al., IEEE Antenna's and Propagation Magazine, vol. 44, No. 3, Jun. 2002.*

"Microstrip Antennas with Frequency Agility and Polarization Diversity," Schaubert et al., IEEE Transactions on Antennas and Propagation, vol. AP-29, No. 1, Jan. 1981.*

(Continued)

*Primary Examiner* — Dameon Levi
*Assistant Examiner* — Graham Smith
(74) *Attorney, Agent, or Firm* — Harness, Dickey & Pierce, P.L.C.

(57) ABSTRACT

A patch antenna system comprises a patch antenna having a patch spatially separated from a ground plane; a plurality of pins interposed between the patch and the ground plane selectively connecting the patch to the ground plane; and a control module operably coupled to the plurality of pins and operable to set an operating frequency characteristic of the patch antenna by selectively connecting the patch to the ground plane with one or more of the plurality of pins.

18 Claims, 5 Drawing Sheets

(56) References Cited

OTHER PUBLICATIONS

S. Mahmoud et al "Broadband Microstrip Patch Antenna With Pin Loading" Kuwait University 2004.

C. Huang et al "Compact Broadband Folded Monopole Antennas With Shorting Pins" Optical Technology Letters/vol. 44; No. 5 Mar. 5, 2005.

L. Greetis et al.,"A self-structuring patch antenna", Antennas and Propagation Society International Symposium, Jul. 5, 2008.

* cited by examiner

VARIABLE FREQUENCY PATCH ANTENNA

CROSS-REFERENCE TO RELATED APPLICATIONS

This application is a continuation-in-part of International Application No. PCT/US2008/080076, filed Oct. 16, 2008 which claims the benefit of U.S. Provisional Application No. 60/999,852 filed on Oct. 19, 2007. The entire disclosure of the above applications are incorporated herein by reference.

FIELD

The present disclosure relates to antennas, and more specifically to patch antennas.

BACKGROUND

Patch antennas are commonly used in a number of applications such as telecommunications and radar applications. A patch antenna may have a ground plane and a metallic patch of a predetermined shape disposed parallel to the ground plane. A dielectric may separate the patch from the ground plane. The region between patch and the ground plane may create a resonant cavity that allows for the radiation of electromagnetic waves.

A patch antenna fashioned in this manner may be easy to manufacture and may have end use advantages compared to other antenna configurations. For example, the ground plane shields the antenna from interference from surrounding lines and electronics, and the antenna may be easily conformed to a surface. The frequency characteristics of a patch antenna are a function of the patch antenna size and geometry, which are generally fixed when the patch antenna is manufactured and the environment into which the manufactured patch antenna is introduced. Many patch antennas may be limited to a single frequency with a narrow bandwidth of only a few percent of the center frequency. It may be difficult to expand the bandwidth of the patch antenna or to operate the patch antenna at multiple frequencies. Moreover, the frequency characteristics of the patch antenna may be changed based on the operating environment or if the patch is damaged.

The statements in this section merely provide background information related to the present disclosure and may not constitute prior art.

SUMMARY

A patch antenna system comprises a patch antenna having a patch spatially separated from a ground plane; a plurality of pins interposed between the patch and the ground plane selectively connecting the patch to the ground plane; and a control module operably coupled to the plurality of pins and operable to set an operating frequency characteristic of the patch antenna by selectively connecting the patch to the ground plane with one or more of the plurality of pins.

A patch antenna system comprises a patch antenna having a patch, a ground plane, and a dielectric interposed between the patch and the ground plane; a plurality of pins disposed in the dielectric and electrically connected to the patch; a plurality of switches electrically connected to the ground plane and the plurality of pins; and a control module in communication with the plurality of switches to selectively electrically connect one or more of the plurality of pins to the ground plane.

A method of modifying frequency characteristics of a patch antenna comprises measuring a frequency characteristic of a patch antenna having a patch and a ground plane; comparing a difference between the measured frequency characteristic and a desired frequency characteristic to a predetermined threshold; and modifying an arrangement of conductive pins selectively connecting the patch to the ground plane based on the comparing, the modifying including connecting or disconnecting one or more pins from one or more locations on the patch.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way. Corresponding reference numerals indicate corresponding parts throughout the several views of the drawings.

DETAILED DESCRIPTION

Figure 1:
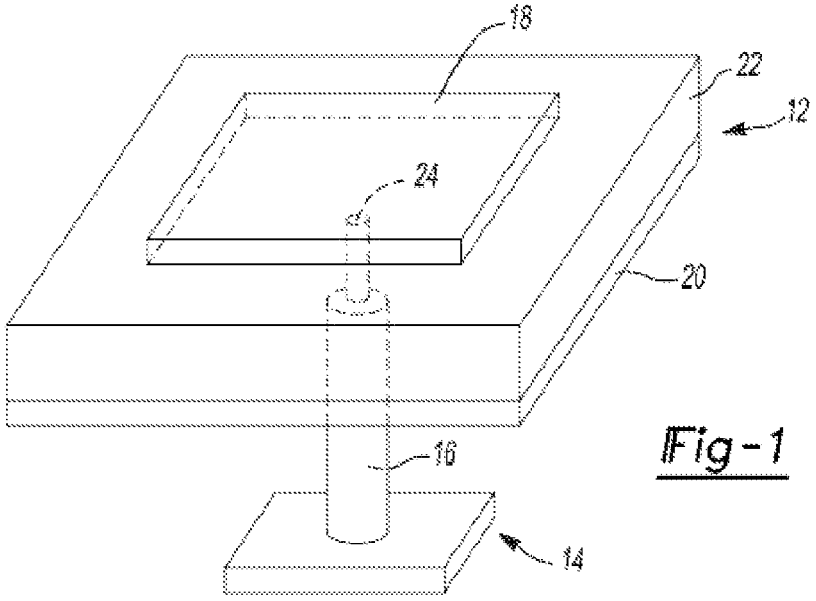
FIG. 1 is a schematic illustration of a patch antenna.

Referring now to FIG. 1, a patch antenna system may include a patch antenna 12, a feed cable 16, and a frequency device 14. Patch antenna 12 may include ground plane 20, patch 18 and dielectric 22. Feed cable 16 may include feed pin 24. Patch antenna 12 may be constructed using etched circuit techniques. Ground plane 20 may be a metallic ground plane of a thin layer of circuit board and patch 18 may be a metallic patch etched onto the surface of the circuit board opposite the ground plane 20. Dielectric 22 may be the circuit board situated between ground plane 20 and patch 18 and may create a resonant cavity for sending or receiving signals at a resonant frequency. Feed pin 24 of feed cable 16 may be in contact with patch 18 such that frequency device 14 may send or receive frequency signals with patch antenna 12. Frequency device 14 may be a transmitter, a receiver, a transceiver, or any other frequency device.

The configuration of patch 18 may be chosen such that patch antenna 12 operates at a particular frequency. The frequency of patch antenna 12 may vary with the size and shape of patch 18 as well as its location relative to ground plane 20 or electrical characteristic of dielectric 22. Changes in the size or shape of patch 18 may change the frequency at which patch antenna 12 operates. Placement of the feed pin 24 may determine the frequency characteristics of the patch antenna 12.

Figure 2:
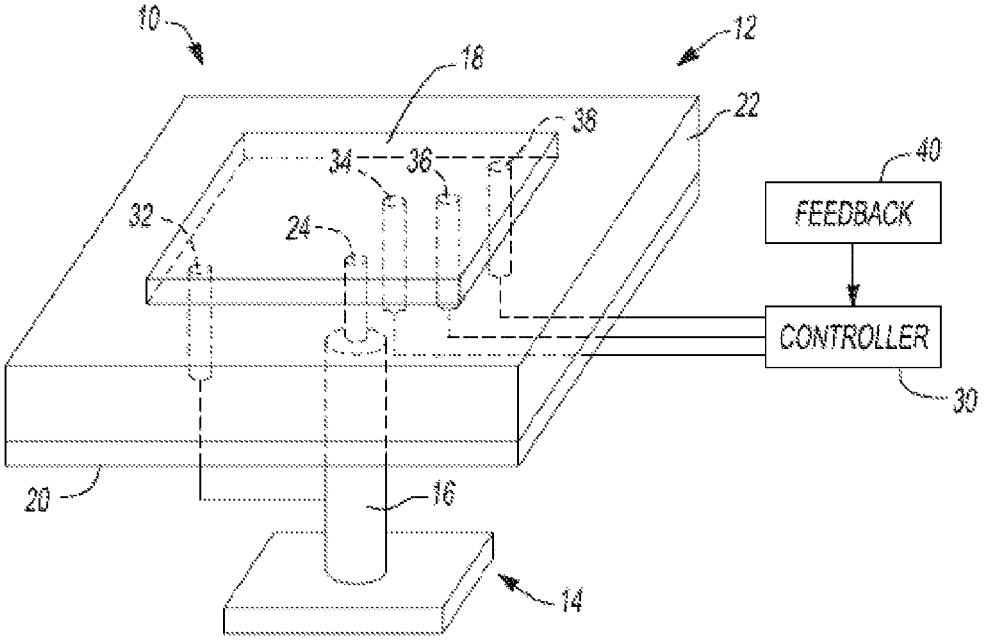
FIG. 2 is a schematic illustration of a variable frequency patch antenna.

Referring now to FIG. 2, a variable frequency patch antenna 10 is depicted. Patch antenna 12, feed cable 16, and frequency device 14 may be configured in a manner similar to FIG. 1. Variable frequency patch antenna 10 may also include feedback 40 and controller 30 in communication with shorting pins 32, 34, 36, and 38. Shorting pins 32, 34, 36, and 38 may be attached to one of patch 18 or ground plane 20 and selectively connected to the other of patch 18 and/or ground plane 20. For purposes of the present disclosure, shorting pins 32, 34, 36, and 38 will be shown attached to patch 18 and selectively attached to ground plane 20.

Controller 30 may provide signals to shorting pins 32, 34, 36 and 38 to selectively connect one or more of the shorting pins to ground plane 20 such that patch 18 is shorted to the ground plane at each location corresponding with the connected shorting pins 32, 34, 36 and/or 38. When one or more of shorting pins 32, 34, 36, and/or 38 is shorted to ground plane 20, the field within the cavity 22 between patch 18 and ground plane 20 is disturbed. In this manner, the frequency characteristics of patch antenna 12 are changed with each shorting pin that shorts ground plane 20 to patch 18.

Although four shorting pins are depicted in FIG. 2, any number of shorting pins may be implemented in a variable frequency patch antenna 10. Moreover, a shorting pin may be located at any location at patch 18. Accordingly, the frequency characteristics of patch antenna 12 will vary based on the number of shorting pins shorted to ground plane 20 and the location of the shorting pins. For a particular arrangement of shorting pins in a variable frequency patch antenna 10, there may be N shorting pins and thus $2^N$ possible frequency behaviors for any single spatial configuration of shorting pins.

The various frequency modes of a particular variable frequency patch antenna 10 configuration may be predetermined or dynamic. In the case of a predetermined variable frequency patch antenna, some or all of the $2^N$ combinations of shorting pins may be tested and the frequency characteristics stored such as in controller 30. In this way, a user of a variable frequency patch antenna 10 could choose from predetermined frequency characteristics stored in controller 30. The shorting pins and controller 30 may be configured for particular applications such that a number of desired frequencies are accessible from a single variable frequency patch antenna 10.

A variable frequency patch antenna 10 may also be dynamic. A dynamic system utilizes feedback 40 to determine frequency characteristics based on the current patch antenna 12 status. Controller 30 may be in communication with feedback 40 and may compare the measured frequency characteristics to a requested or desired frequency characteristic. Controller 30 may then modify the shorting pin arrangement to create a different frequency characteristic which may again be received by feedback 40. This process of shorting pins and receiving feed back may continue until a desired frequency characteristic is achieved by variable frequency patch antenna 10 within a predetermined error threshold.

Feedback will be provided by a frequency device such as a receiver. The frequency device will measure some property of the antenna's performance, such as impedance, standing-wave ratio, insertion loss, bandwidth, directivity, bit-error rate, near-zone field, etc. This quantity will depend on the operating frequency (or frequencies) of the antenna. A measure of this characteristic is sent to the controller, and the controller uses this information in its algorithm to determine how to set the configurations of the antenna. In a dynamic mode, this characteristic will be monitored and fed back continuously to the algorithm, and the algorithm will decide when and how to use this information to change antenna configurations to optimize the measured value of the characteristic. In one exemplary implementation, the receiver will supply a value of the standing-wave ratio (SWR) to the controller, and the algorithm will seek to minimize the SWR by setting an appropriate sequence of configurations of the antenna. When a predefined target value is reached, the algorithm discontinues setting configurations, and the system operates using the most recent configuration. However, the controller continues to monitor the SWR to determine if it rises above the target value (due to a change in operating frequency or a change in the electrical environment of the antenna—position, orientation, location of nearby objects, etc). If it rises above the target value, the algorithm is run again to bring it below the target value. A combination of predetermined and dynamic modes is contemplated. For instance, operating characteristic may be monitored, but changes to the antenna configuration are made only if and when the measured characteristic drops below a target value.

Variable frequency patch antenna 10 frequency characteristic may not be solely dependent on the size and shape of patch 18, since the shorting pins may change the frequency characteristic. Accordingly, greater variation in patch size and shape may be possible. Irregularly shaped patches and patch antennas may be used in applications where a conventional shape (i.e., rectangular, circular, etc.) would not fit. It should be noted, however, that while the specific shape or size may no longer be determinative of a specific end-use frequency characteristic, the size and shape of patch 18 may dictate a useable range of frequency characteristics achievable with variable frequency patch antenna 10.

Figure 3:
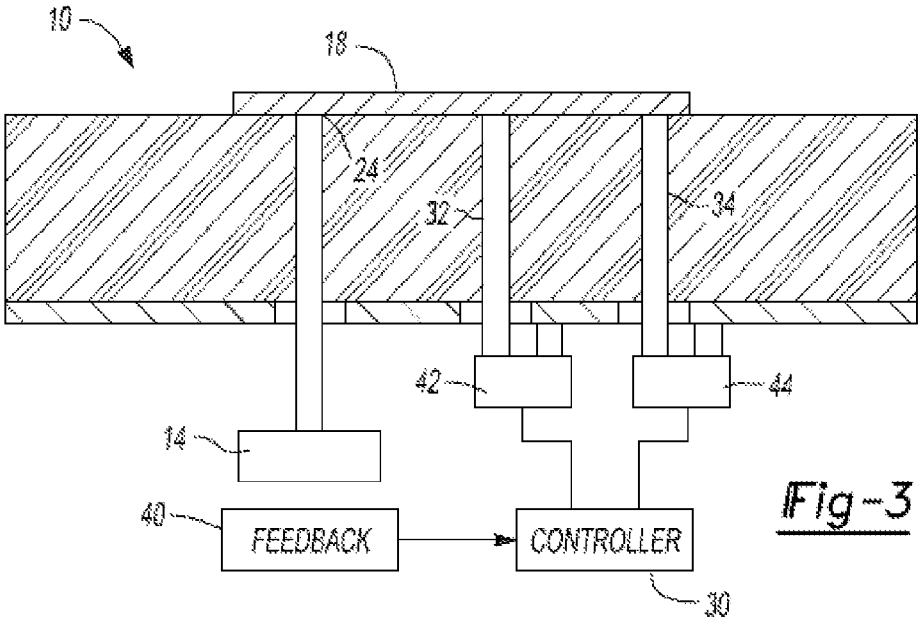
FIG. 3 is a section view of a variable frequency patch antenna.

Referring now to FIG. 3, a sectional view of a variable frequency patch antenna 10 is depicted. Patch 18 of patch antenna 12 is depicted with feed pin 24, feed cable 16 and shorting pins 32 and 34 directly electrically connected to patch 18. Ground plane 20 of patch antenna 12 is depicted with through holes to allow feed pin 24 and shorting pins 32 and 34 to pass through ground plane 20 without forming an electrical connection with ground plane 20. Dielectric 22 is disposed between patch 18 and ground plane 20 while feed cable 16 is in contact with frequency device 14.

Switches 42 and 44 may be in contact with shorting pins 32 and 34 and ground plane 20. Switches 42 and 44 may be controlled by controller 30. Switches 42 and 44 may be any switch that may selectively connect shorting pins 32 and 34 to ground plane 20 such as a PIN diode or other electronic switch, a relay or other electromechanical switch, or a microelectromechanical system (MEMS) switch, or any other electrical or mechanical switch. Switches 42 and 44 may be in communication with controller 30 which may command switches 42 and 44 to allow electrical connection between patch 18 and ground plane 20.

When patch 18 is shorted to ground plane 20 through any of switches 42 and 44 or any other switches, the frequency characteristics of variable frequency patch antenna 10 may be changed from the previous frequency characteristics. Feedback 40 may measure the frequency characteristics of variable frequency patch antenna 10 and the information may be communicated to controller 30. Controller 30 may continue to change the arrangement of shorted pin locations with a fast-searching algorithm if the measured frequency characteristic is not within a predetermined threshold of the desired frequency characteristic. Feedback 40 may monitor a frequency characteristic of a new pin arrangement until a desired frequency characteristic is reached as explained above.

The desired frequency characteristics of the variable frequency patch antenna may include a target frequency, a target bandwidth or multiple frequency operation, or a performance criterion such as impedance, standing-wave ratio, or bit-error rate. The variable frequency patch antenna 10 may operate at numerous resonant frequencies and may be used to expand bandwidth at a frequency. A variable frequency patch antenna 10 may also operate at multiple frequencies at one time.

In the feedback 40 embodiment, a desired frequency characteristic may be maintained in spite of changing operating conditions or even a change in patch 18 shape. This is because frequency characteristics are no longer dependent solely upon patch geometry but may be based on a pattern of shorting pins. If the patch geometry is changed, feedback 40 and controller 30 may modify the shorting pin arrangement to acquire a similar frequency characteristic for the modified patch 18.

Figure 4A:
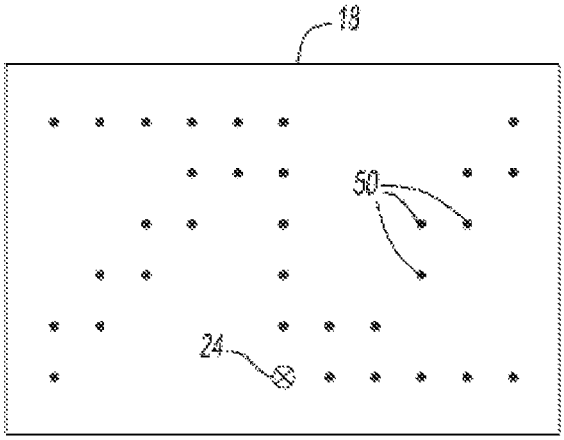
FIGS. 4A and 4B are views exemplary pin patterns for a variable frequency patch antenna.
Figure 4B:
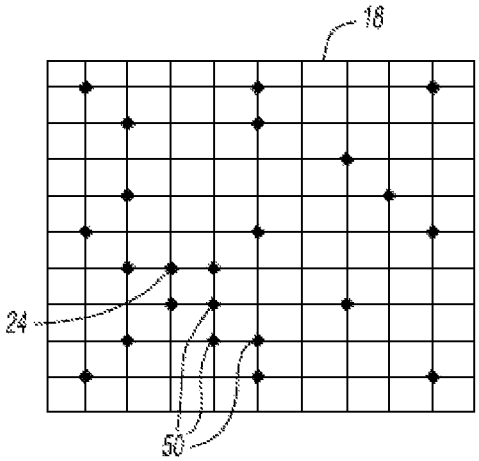

FIGS. 4A and 4B illustrate exemplary pin arrangements for the patch antenna system 10. In each example arrangement, the plurality of shorting pins 50 are arranged in an asymmetric or irregular manner and are dispersed across a considerable amount of the outwardly facing surface of the patch. More specifically, a relatively large number of pins are positioned along the perimeter of the patch, including at the corners, thereby allowing for frequency agility at lower frequencies. In addition, a portion of the pins are clustered near the feed which allows for frequency agility at higher frequencies. Remaining pins are spread throughout the patch area to allow for frequency agility across a wide band, between the higher and lower frequencies. Thus, the asymmetric arrangement allows for a wide diversity of antenna states that produce no repeated states. The arrangements shown in FIGS. 4A and 4B are merely exemplary in nature. It is readily understood that the specific pattern and location of the shorting pins and the feed pin may be changed with the scope of this disclosure.

In an exemplary embodiment, the size of the patch is 30 mm by 46 mm with a substrate thickness of 2.87 mm and a permittivity of 2.2. The feed pin is placed 23 mm from the left edge of the patch and 4.3 mm from the bottom edge of the patch. The variable frequency patch antenna of FIG. 4 may operate in a range of 2 GHz to 9 GHz with a VSWR value of less than 1.1 based on the shorting pin arrangement. At any frequency within this band that could be optimized for the variable frequency patch antenna, a return loss of at least −28 dB was reached. A number of the frequencies in this band had lower return losses, with some running as low as −67 dB.

Figure 5:
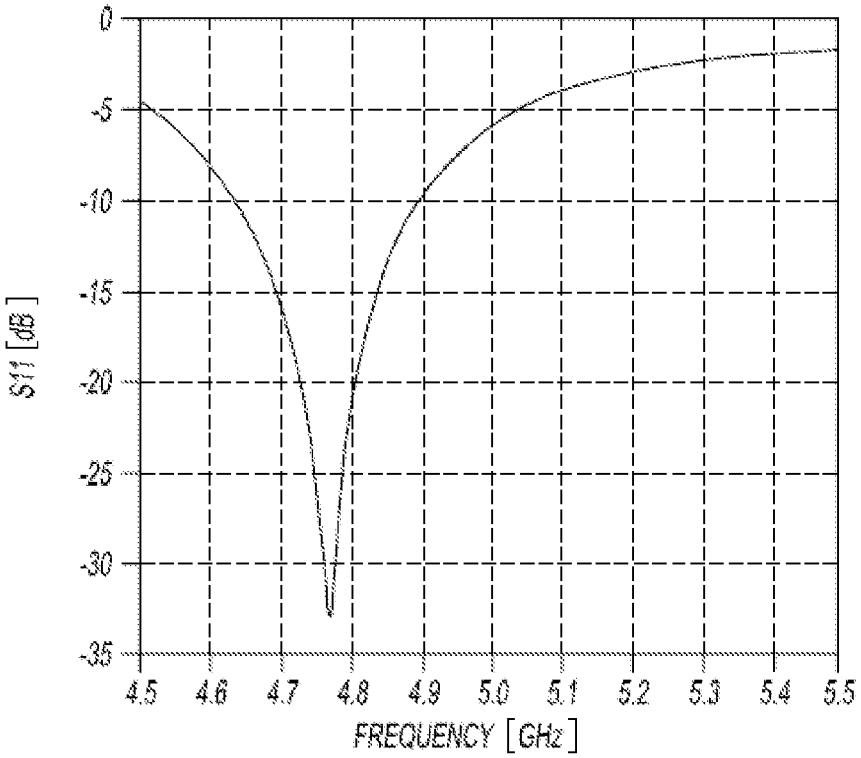
FIG. 5 is a frequency plot of return loss of a traditional patch antenna.

Referring now to FIG. 5, frequency characteristics for a conventional patch antenna are demonstrated at approximately 5 GHz. The patch has dimensions of 19.8 mm by 19.8 mm, with the feed pin 6.6 mm from the left edge of the patch and 6.6 mm from the bottom edge of the patch. The permittivity of the dielectric layer is 2.2. This conventional patch antenna has a return loss relative to 50 Ohms as a function of frequency as demonstrated in FIG. 5. The return loss at the resonant frequency of 4.768 GHz is −33 dB and the −10 dB bandwidth is approximately 0.25 GHz or 5 percent.

Figure 6:
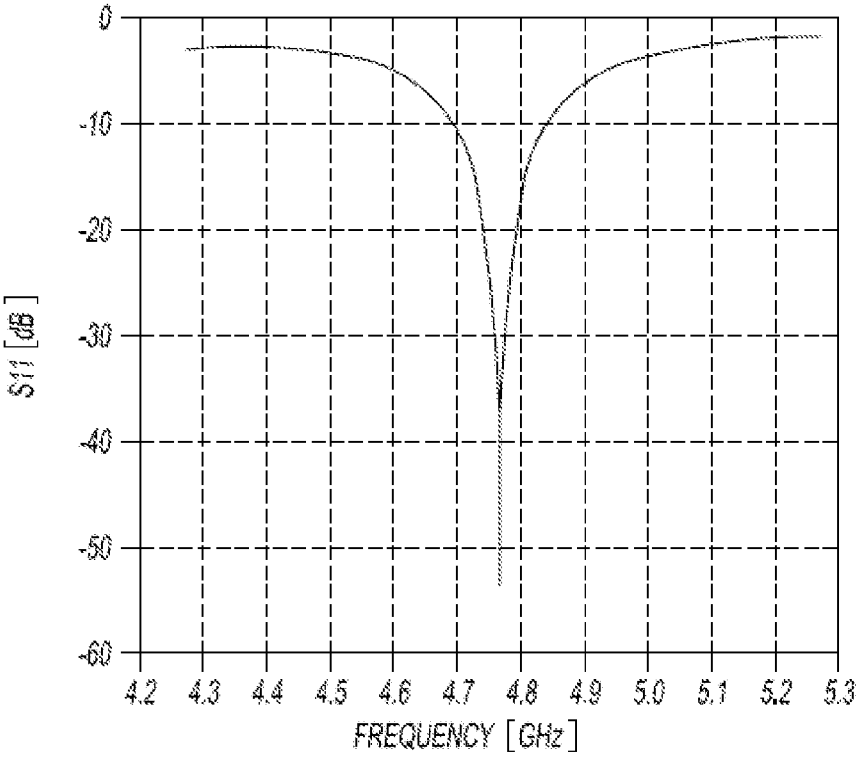
FIG. 6 is a frequency plot of return loss for the variable frequency patch antenna of FIG. 4A optimized for the same frequency as the conventional patch antenna of FIG. 5.

Referring now to FIG. 6, the variable frequency patch antenna of FIG. 4A was optimized for the same frequency as the conventional patch antenna of FIG. 5. The variable frequency patch has dimensions of 30 mm by 46 mm with 32 shorting pins configured as in FIG. 4A. When optimized at the resonant frequency of the antenna of FIG. 5, the variable frequency patch antenna demonstrated a return loss of −53 dB, or well below the −33 dB return loss of the antenna of FIG. 5. The increased return loss demonstrates better matching than the antenna of FIG. 5.

Figure 7:
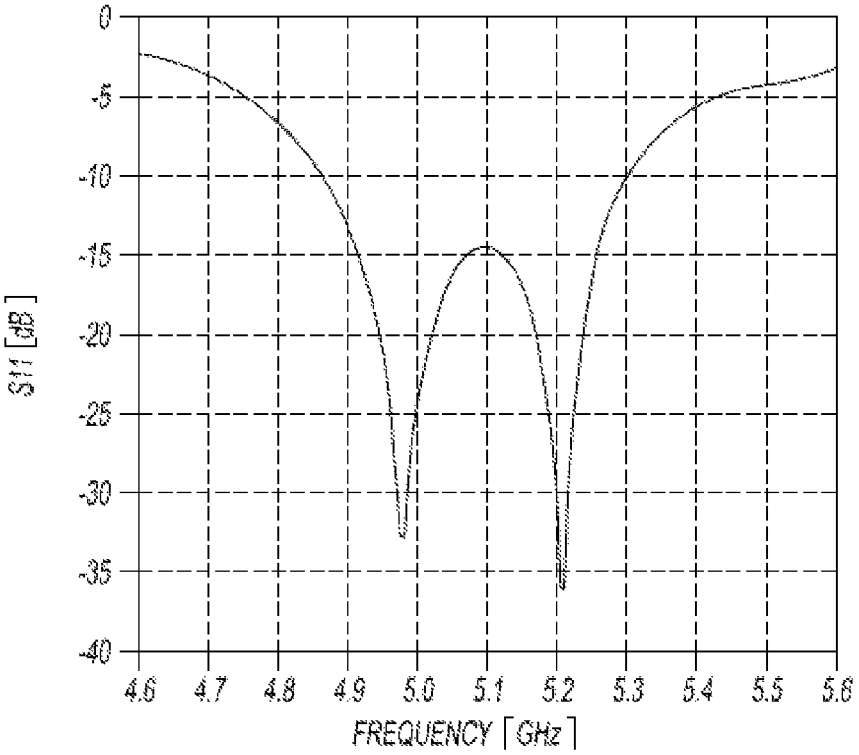
FIG. 7 is a frequency plot of return loss for the variable frequency patch antenna of FIG. 4A optimized to resonate at 5.0 and 5.2 gigahertz (GHz)

Referring now to FIG. 7, the variable frequency patch antenna of FIG. 4A is demonstrated with multiple resonant frequencies at 5.0 GHz and 5.2 GHz. Each of the resonant frequencies has a return loss of greater than −33 dB and because the resonant frequencies are located close together the −10 dB bandwidth is nearly 0.45 GHz. This bandwidth is significantly greater than the bandwidth of a traditional patch.

Figure 8:
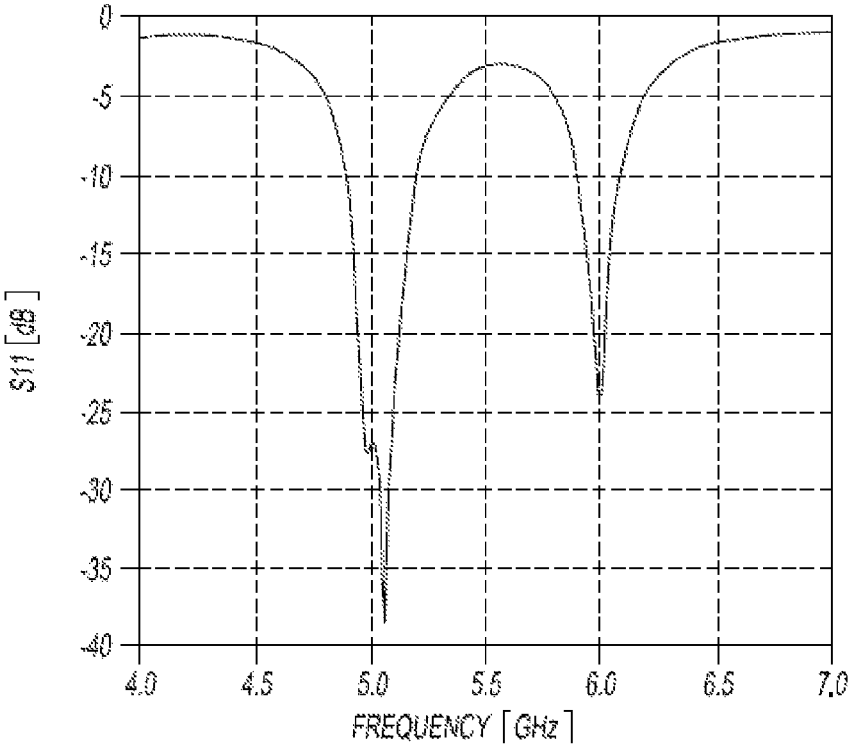
FIG. 8 is a frequency plot of return loss for the variable frequency patch antenna of FIG. 4A optimized to resonate at 5.0 GHz and 6.0 GHz.

Referring now to FIG. 8, the variable frequency patch antenna of FIG. 4A is demonstrated with resonant frequencies relatively far apart at approximately 5 GHz and 6 GHz. A return loss of at least −24 dB is demonstrated at each frequency. FIG. 8 demonstrates that the variable frequency patch antenna can be configured to operate at multiple frequencies.

Figure 9:
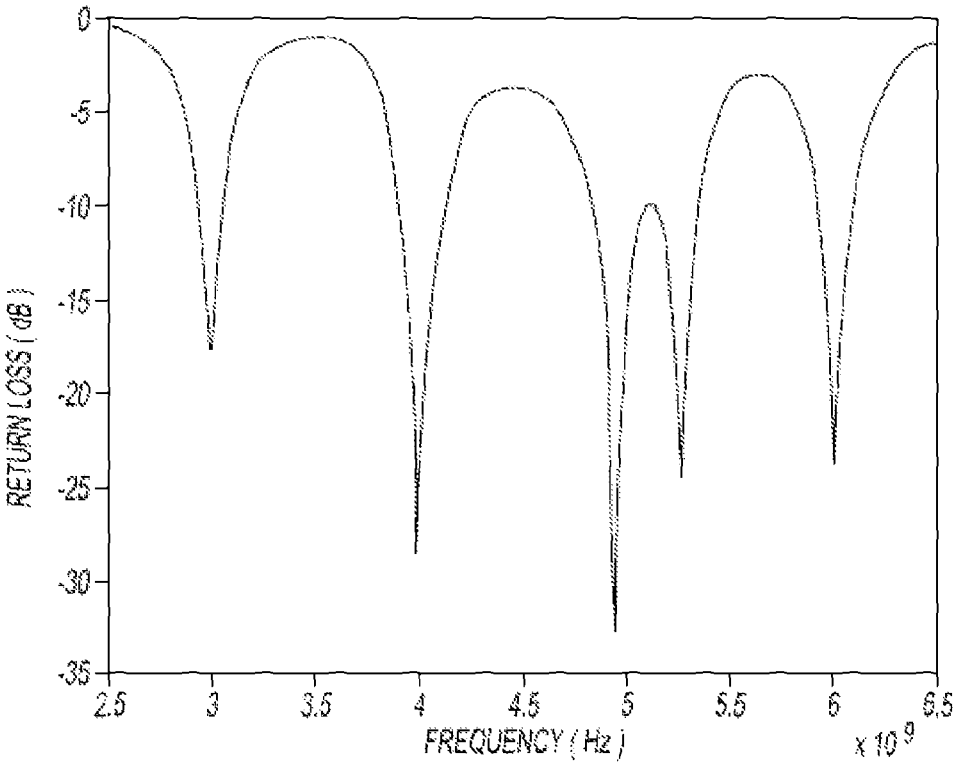
FIG. 9 is a frequency plot of return loss for the variable frequency patch antenna of FIG. 4A optimized to resonate at 3, 4, 5, and 6 GHz.

Referring to FIG. 9, the variable frequency patch antenna of FIG. 4A is demonstrated with multiple resonant frequencies at 3 GHz, 4 GHz, 5 GHz and 6 GHz. The VSWR value at each frequency varies between 1.16 and 1.35. On the plot, there are five distinct resonances. This figure demonstrates that the variable frequency patch antenna can be configured at four frequencies simultaneously. While exemplary embodiments configured to operate at one, two and four frequencies have been described above, it is readily understood that the variable frequency patch antenna can be configured to operate at any number of frequencies.

An exemplary prototype of a variable frequency patch antenna was constructed from a Taconic TLY-5 circuit board that has dimensions of 15 inches by 18 inches, a thickness of 5 mm, and a relative permittivity of 2.2. Copper was milled off of the top surface of the board to leave a patch with dimensions of 9 inches by 15 inches. Thirty-three holes were then drilled through the board for the thirty-two shorting posts and one feed pin. These shorting posts are arranged in the same pattern as the shorting posts in the simulated patch antenna. On the bottom of the board, copper rings were removed around each shorting post hole in order to electrically isolate small areas of copper, called copper pads. A wire was then placed through each hole and soldered to the patch surface and the copper pad on the bottom of the board. This wire was then soldered to one leg of a switch and the other leg of the switch was soldered to the ground plane of the patch. When the switch is open, the surface of the patch and the ground plane are disconnected and remain electrically isolated from each other. When the switch is closed, the wire becomes connected to the ground plane through the switch, shorting the patch surface and the ground plane together. The prototype is controlled using a laptop personal computer. The switches are opened and closed using a digital input/output card under the control of various software programs, including a genetic algorithm. Feedback is received using an analog-to-digital card, which reads signal strength from a receiver.

Measurements were taken in relation to the prototype to get a statistical sense of the antenna performance. The first measurements that were taken were to record the voltage standing wave ratio (VSWR) of 75,000 randomly generated states of the patch antenna at several arbitrarily chosen frequencies within the range from 200 MHz to 900 MHz. With 32 switches, there are 4.3 billion possible states of the antenna. Looking at 75,000 random states is looking at 0.0017% of all possible states. Once all measurements were taken, the lowest VSWR was recorded and two histograms were made (not included). The first of these histograms shows the distribution of all states with a VSWR below 50, to get an idea of the total distribution of states. The second histogram shows only the states with a VSWR below 2. This histogram gives an idea of how many states of the antenna have very low VSWR values. Once the 75,000 random states had been searched, a genetic algorithm was run at the same frequencies to see if a state with a lower VSWR could be found. Unlike the random search, the genetic algorithm was usually able to find states with low VSWR values after looking at less than 10,000 states. Once the genetic algorithm had been run, the antenna was set to the state with the lowest VSWR and connected to a network analyzer to measure the return loss and bandwidth of that state.

The above description is merely exemplary in nature and is in no way intended to limit the invention, its application, or uses. For purposes of clarity, the same reference numbers may be used in the drawings to identify the same elements. As used herein the term module, controller and/or device refers to an application specific integrated circuit (ASIC), an electronic circuit, a processor (shared, dedicated, or group) or memory that execute one or more software or firmware programs, a combinational logic circuit, or other suitable components that provide the described functionality. Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent the skilled practitioner upon a study of the drawings, the specification and the following claims.

What is claimed is:

1. A patch antenna system comprising:

a patch antenna having a patch, a ground plane, and a dielectric interposed between the patch and the ground plane;

a feed pin electrically coupled to the patch for transmitting or receiving signals;

a plurality of pins disposed in the dielectric and electrically coupled to the patch, the plurality of pins are dispersed in an irregular manner throughout the patch, including a first subset of pins arranged along a perimeter of the patch, including a pin at each corner of the patch, and a second subset of the pins spatially separated in an inward direction from the perimeter of the patch and clustered around the feed pin;

a plurality of switches electrically connected to the ground plane and the plurality of pins; and a control module in communication with the plurality of switches and operable to set an operating frequency characteristic of the patch antenna by selectively electrically connecting one or more of the plurality of pins to the ground plane.

2. The patch antenna system of claim 1 wherein the patch having an outwardly facing surface such that pins are dispersed substantially along a perimeter of the surface.

3. The patch antenna system of claim 2 wherein the outwardly facing surface of the patch having a rectangular shape such that a pin is positioned near each corner of the surface.

4. The patch antenna system of claim 2 wherein the plurality of pins are dispersed across a considerable amount of the area defined by the surface.

5. The patch antenna system of claim 1, further comprising a feedback device in communication with the control module and operable to determine a frequency of the patch antenna.

6. The patch antenna system of claim 5, wherein the control module is operable to selectively connect one or more of the plurality of pins to the ground plane based on a comparison between the frequency at the feedback device and a requested frequency.

7. The patch antenna system of claim 1, wherein the requested frequency characteristic includes a bandwidth at the requested frequency.

8. The patch antenna system of claim 1, wherein the requested frequency characteristic includes a plurality of resonant frequencies.

9. A patch antenna system comprising:

a patch antenna having a patch having an outwardly facing surface, a ground plane, and a dielectric interposed between the patch and the ground plane;

a feed pin electrically coupled to the patch for transmitting or receiving signals;

a plurality of pins disposed in the dielectric and electrically connected to the patch, the plurality of pins are dispersed in an asymmetric manner throughout a substantial portion of the patch, including a first subset of pins arranged along a perimeter of the patch, including at each corner of the patch, and a second subset of pins spatially separated in an inward direction from the perimeter and clustered spatially proximate to each other and around the feed pin, such that one pin of the second subset is positioned between the feed pin and an edge of the patch and another pin of the second subset is positioned between the feed pin and a different edge of the patch;

a plurality of switches electrically connected to the ground plane and the plurality of pins; and a control module in communication with the plurality of switches to selectively electrically connect one or more of the plurality of pins to the ground plane.

10. The patch antenna system of claim 9 wherein the feed pin is electrically connecting the patch to a frequency device for sending or receiving signals.

11. The patch antenna system of claim 9, further comprising a frequency feedback device in communication with the control module.

12. The patch antenna system of claim 9 wherein the outwardly facing surface of the patch having a rectangular shape such that a pin is positioned near each corner of the surface.

13. The patch antenna system of claim 9, wherein one or more of the plurality of switches short circuit to selectively electrically connect one or more of the plurality of pins to the ground plane.

14. The patch antenna system of claim 13, wherein one or more of the plurality of switches open circuit to prevent electrical connection between one or more of the plurality of pins and the ground plane.

15. The patch antenna system of claim 9, wherein the plurality of switches are located outside of the patch antenna adjacent to the ground plane.

16. The patch antenna system of claim 15, wherein the ground plane includes openings for the plurality of pins to electrically connect to the plurality of switches.

17. The patch antenna system of claim 16, wherein the plurality of pins extend through the openings of the ground plane to electrically connect to the plurality of switches.

18. A patch antenna system comprising:

a patch antenna having a patch, a ground plane, and a dielectric interposed between the patch and the ground plane;

a feed pin disposed spatially inward from a perimeter and electrically coupled to the patch for transmitting or receiving signals;

a plurality of pins disposed in the dielectric and electrically coupled to the patch, the plurality of pins are dispersed in an irregular manner throughout the patch, including a first subset of at least four pins arranged at each corner of the patch and a second subset of at least three pins arranged inward from the perimeter and clustered spatially proximate to each other and around the feed pin and a third subset of pins mutually exclusive from the first and second subset of pins and dispersed elsewhere in patch;

a plurality of switches electrically connected to the ground plane and the plurality of pins, each switch is electrically connected between the ground plane and a different one of the plurality of pins; and a control module in communication with the plurality of switches and operable to set an operating frequency characteristic of the patch antenna by selectively electrically connecting two or more of the plurality of pins to the ground plane.

* * * * *